US011339512B2

(12) United States Patent
Kajiwara et al.

(10) Patent No.: US 11,339,512 B2
(45) Date of Patent: May 24, 2022

(54) ELASTICALLY DEFORMABLE STRING

(71) Applicant: TWINS CORPORATION, Funabashi (JP)

(72) Inventors: Ryuji Kajiwara, Funabashi (JP); Takashi Tsuchida, Funabashi (JP)

(73) Assignee: TWINS CORPORATION, Funabashi (JP)

( * ) Notice: Subject to any disclaimer, the term of this patent is extended or adjusted under 35 U.S.C. 154(b) by 0 days.

(21) Appl. No.: 17/053,729

(22) PCT Filed: Apr. 1, 2019

(86) PCT No.: PCT/JP2019/014414

§ 371 (c)(1),
(2) Date: Nov. 6, 2020

(87) PCT Pub. No.: WO2020/095465

PCT Pub. Date: May 14, 2020

(65) Prior Publication Data

US 2021/0123172 A1 Apr. 29, 2021

(30) Foreign Application Priority Data

Nov. 7, 2018 (JP) ..... JP2018-209808

(51) Int. Cl.
*D04C 1/12* (2006.01)
*D04B 21/20* (2006.01)
(Continued)

(52) U.S. Cl.
CPC ..... *D04C 1/12* (2013.01); *A43C 1/02* (2013.01); *D04B 21/202* (2013.01); *D04C 1/02* (2013.01);
(Continued)

(58) Field of Classification Search
CPC ..... D04C 1/02; D04C 1/12; D04C 2201/102; D04C 2201/1096; A43C 1/02; Y10T 24/3787
See application file for complete search history.

(56) References Cited

U.S. PATENT DOCUMENTS 1,533,964 A * 4/1925 Berman ..... A43C 1/02 24/715.3
2,869,205 A * 1/1959 Kacowski ..... A43C 1/02 24/715.3
(Continued)

FOREIGN PATENT DOCUMENTS

EP 1795085 A1 6/2007
JP S4899444 A 12/1973
(Continued)

OTHER PUBLICATIONS

International Search Report (ISR) dated Aug. 27, 2019, issued for International application No. PCT/JP2019/014414. (2 pages).
(Continued)

*Primary Examiner* — Shaun R Hurley
(74) *Attorney, Agent, or Firm* — Law Office of Katsuhiro Arai

(57) ABSTRACT

A elastically deformable string includes an outer layer and a core material placed inside the outer layer, wherein the outer layer has knob parts that are constituted by loosely woven outer layer yarns and elastically deformable, and link parts that are constituted by densely woven outer layer yarns and have a smaller diameter than the knob parts, wherein the loosely woven outer layer yarns are woven more loosely than are the densely woven outer layer using same yarns, and the core material is constituted by a stretchable string and placed inside the knob parts in a slackened and/or meandering state. The elastically deformable string is suit-
(Continued)

(a)

(b)

able for shoes, for example, as a shoelace which does not require knots.

19 Claims, 5 Drawing Sheets

(51) Int. Cl.
*D04C 1/02* (2006.01)
*D07B 1/02* (2006.01)
*A43C 1/02* (2006.01)

(52) U.S. Cl.
CPC ..... *D07B 1/02* (2013.01); *D07B 2201/102* (2013.01); *D07B 2201/1014* (2015.07); *D07B 2201/1096* (2013.01)

(56) References Cited

U.S. PATENT DOCUMENTS 3,110,945 A * 11/1963 Howe, Jr. ..... A43C 9/00 24/713
4,694,541 A * 9/1987 Skyba ..... F16F 1/46 24/300
5,272,796 A * 12/1993 Nichols ..... A43C 9/00 24/712
5,673,546 A * 10/1997 Abraham ..... A43C 9/00 24/713
6,513,210 B1 2/2003 Gonzalez
7,549,201 B2 * 6/2009 Kraft ..... A43C 1/02 24/713
D606,296 S * 12/2009 Mouton ..... D2/978
8,832,913 B2 * 9/2014 Kajiwara ..... A43C 1/003 24/715.3
9,314,324 B2 * 4/2016 Janardhan ..... A61B 17/22032
9,675,137 B2 * 6/2017 Wu ..... A43C 1/02
10,165,831 B2 * 1/2019 Tsai ..... A43C 9/02
11,033,078 B2 * 6/2021 Cogliandro ..... A43C 7/005
2012/0232655 A1 * 9/2012 Lorrison ..... D03D 3/02 623/13.19
2013/0205553 A1 * 8/2013 Lin ..... A43C 9/00 24/712
2013/0255045 A1 * 10/2013 Gonzalez ..... D07B 5/005 24/715.3
2014/0007392 A1 * 1/2014 Kajiwara ..... D04C 1/02 24/715.3
2017/0065026 A1 * 3/2017 Wu ..... A43C 1/02
2017/0367442 A1 * 12/2017 Tsai ..... A43C 9/02
2018/0220742 A1 * 8/2018 Liu ..... A43C 9/00

FOREIGN PATENT DOCUMENTS

JP S5336904 U 3/1978
JP 2002541352 A 12/2002
JP 3493002 B2 2/2004
JP 5079926 B1 11/2012
JP 5392519 B1 1/2014
JP 2014012912 A 1/2014
JP 2015112445 A 6/2015
JP 2015520302 A 7/2015
JP 2018094011 A 6/2018
JP 2018157994 A 10/2018
WO 2013149246 A1 10/2013

OTHER PUBLICATIONS

Extended European Search Report (EESR) dated Feb. 10, 2022, issued for European counterpart patent application No. EP19882064.9 (9 pages).

* cited by examiner

[FIG. 1]
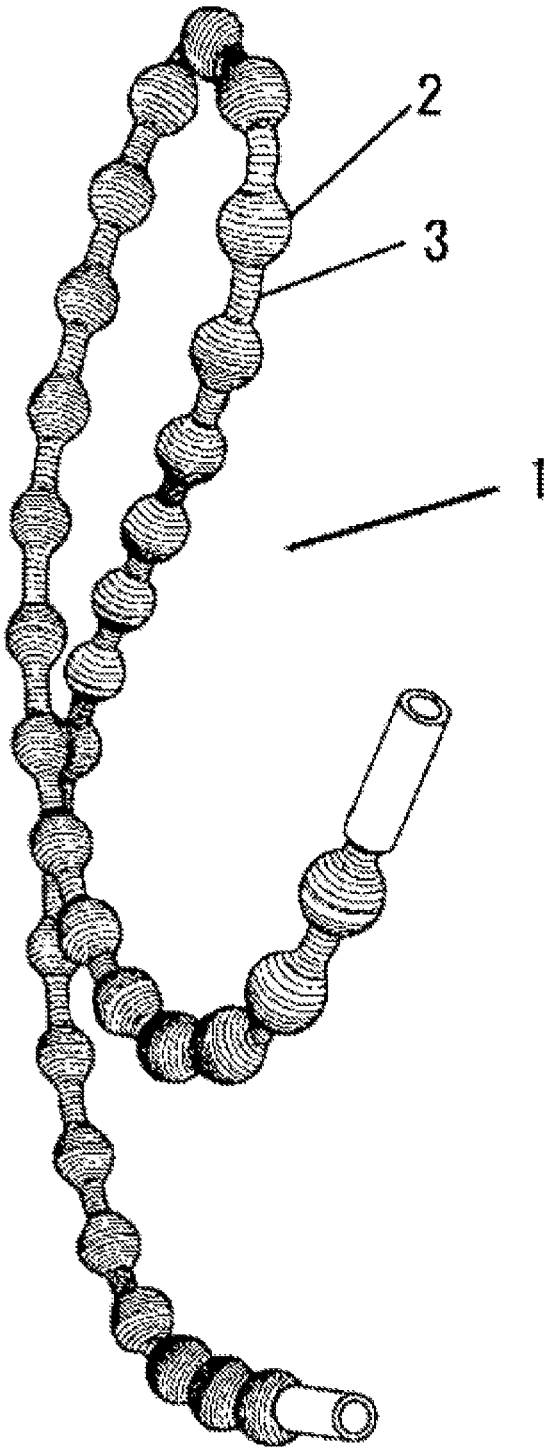

[FIG. 2]
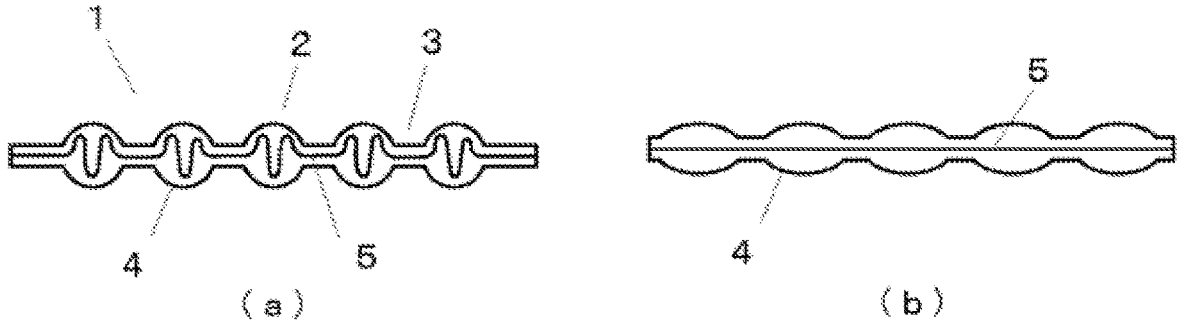
[FIG. 3]
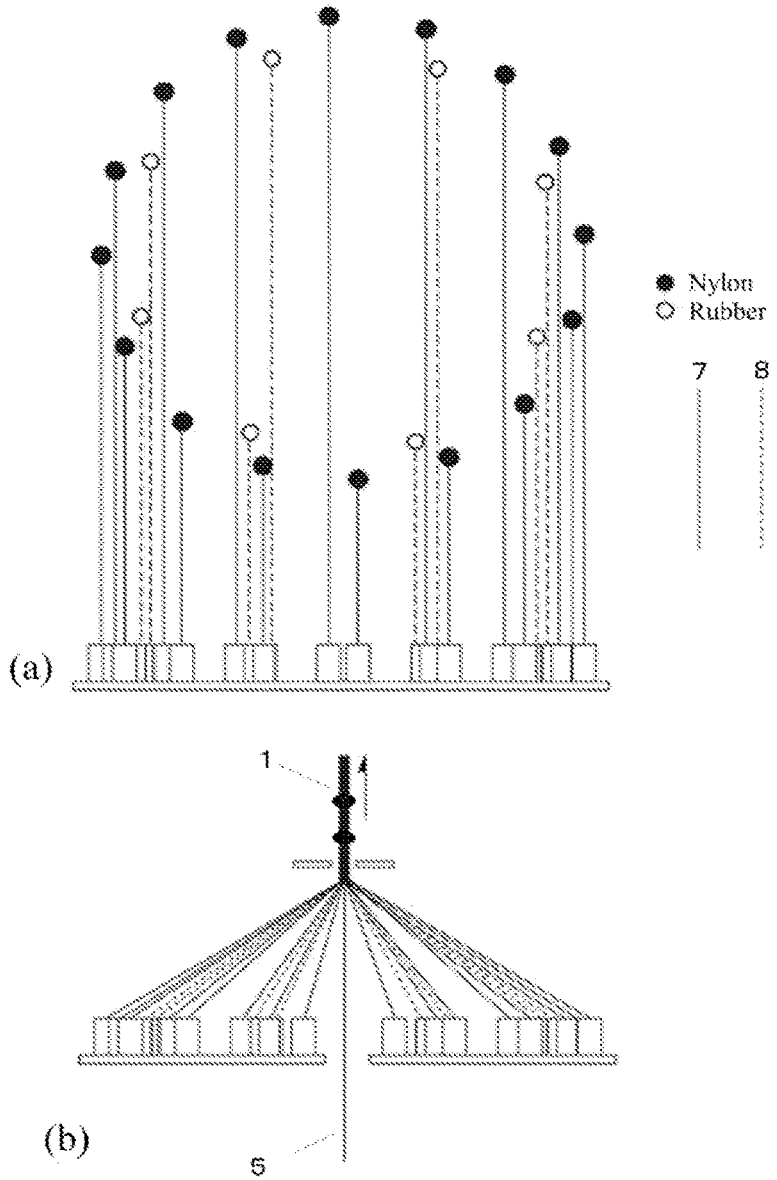

[FIG. 4]
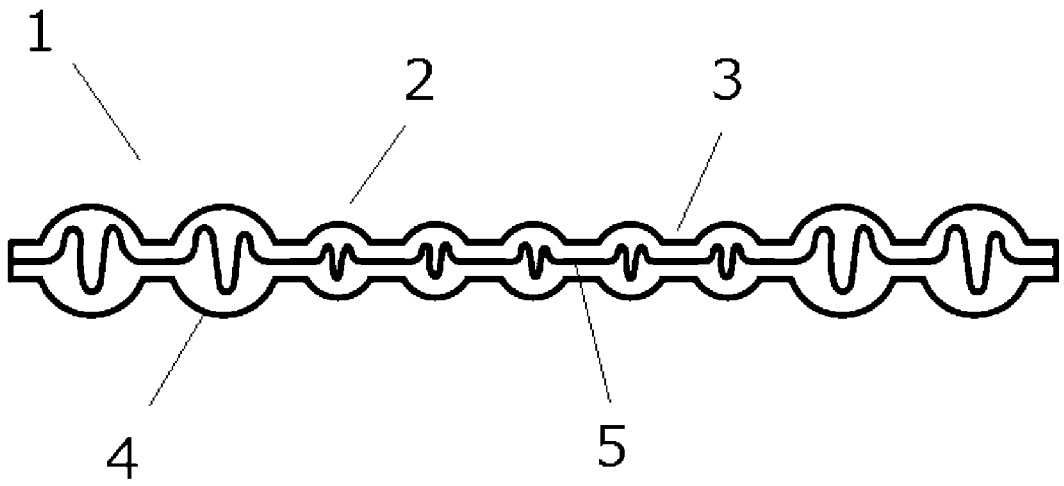
[FIG. 5]
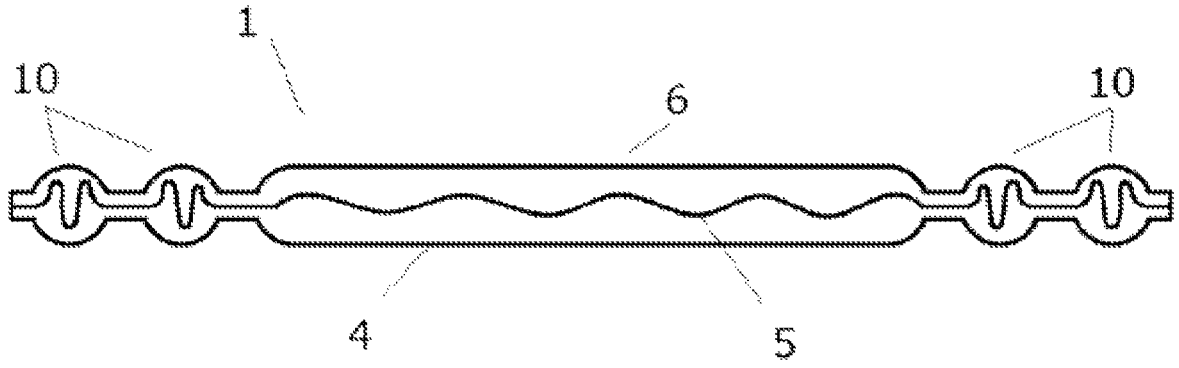

[FIG. 6]
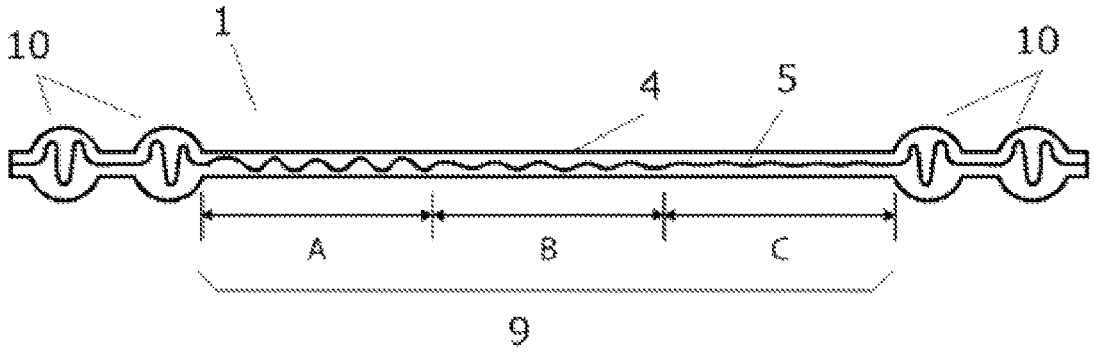
[FIG. 7]
Background Art
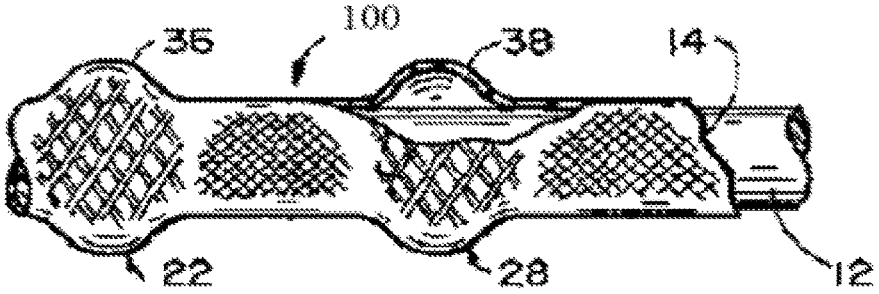
[FIG. 8]
Background Art
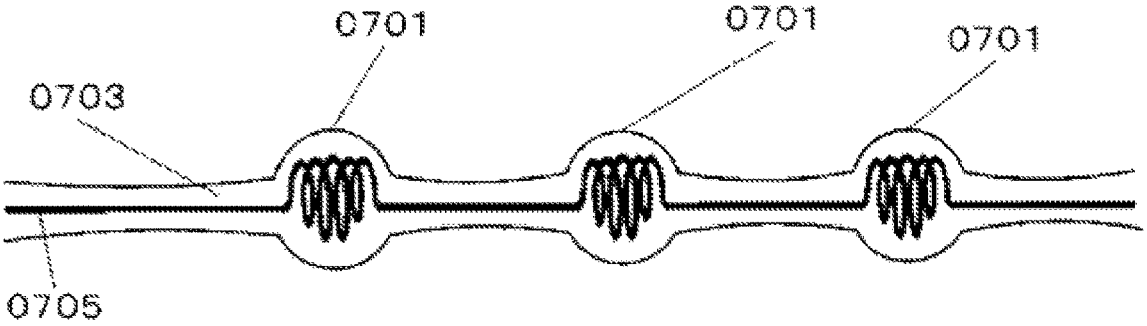

[FIG. 9]
Background Art
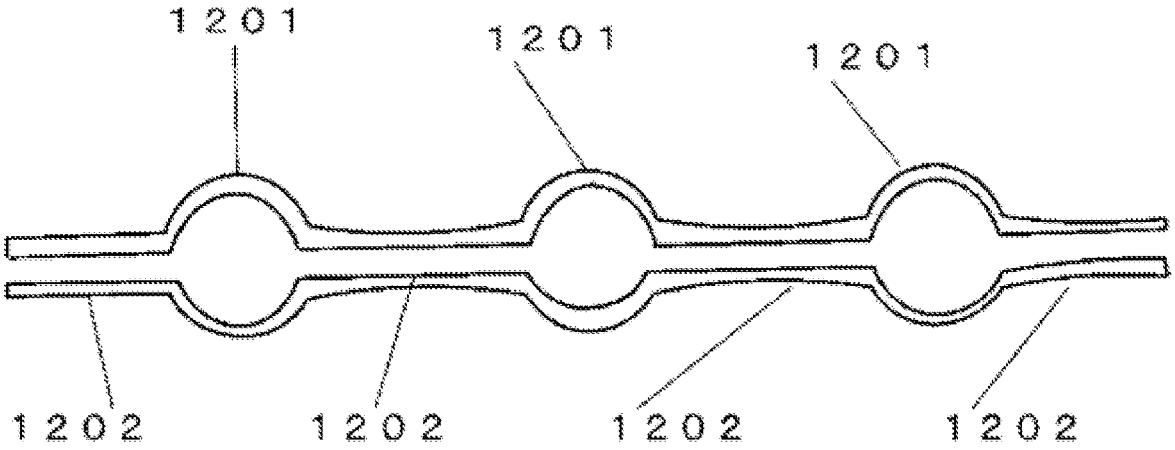

ELASTICALLY DEFORMABLE STRING

CROSS-REFERENCE TO RELATED APPLICATIONS

This application is the U.S. National Phase under 35 U.S.C. § 371 of International Application PCT/JP2019/014414, filed Apr. 1, 2019, which claims priority to Japanese Patent Application No. JP2018-209808, filed Nov. 7, 2018. The International Application was published under PCT Article 21(2) in a language other than English.

TECHNICAL FIELD

The present invention relates to an elastically deformable string that does not require knots.

BACKGROUND ART

Elastically deformable strings that do not require knots have long been well known. To be specific, an elastically deformable string comprises knob parts that can deform elastically in the direction of axis when a pulling force is applied to the string from the direction of axis, and link parts that link these knob parts together, where the three mainstream constructions are illustrated in Patent Literatures 1 to 3 below.

The traditional strings with knob parts illustrated in Patent Literatures 1 to 3 all have pros and cons and are unable to fully satisfy the requirements of the user.

FIG. 7 is a drawing showing the string (100) described in Patent Literature 1. It is constituted by an outer layer (14) made of non-stretchable fiber material woven into the exterior side of a core material (12) made of rubber or other elastic material, with knob parts (36, 38) formed by "slacks" in the fiber material. The string (100) deforms elastically due to the action of the rubber or other core material (12) placed in a straight line at the center of the string, and because portions (22, 28) corresponding to the knob parts (36, 38) are what primarily stretch and contract, meaning that stresses concentrate on these same parts of the rubber or other core material (12), the core material (12) is subject to local deterioration from repeated uses, and also because the knob parts (36, 38) are "slacks" in the non-stretchable fiber material, they generate high frictional resistance when passing through a string hole, resulting in the user injuring his/her fingers when setting the string (100) in the string hole, or the string (100) getting caught easily by the string hole and in some cases damaging the string hole itself.

FIGS. 8 and 9 are drawings showing the strings described in Patent Literatures 2 and 3, which were improved by the present applicant in order to solve the problems presented by the invention described in Patent Literature 1 above. The center strings (0705, the center in portion 1202) described in Patent Literatures 2 and 3 (corresponding to the core material in the present invention) are each constituted by a non-stretchable material that does not deform elastically, and the knob parts (0701, 1201) are deformed elastically solely by the stretchable, tubular main string body (0703) (corresponding to the outer layer in the present invention). This reduces the force needed to elastically deform the knob parts (0701, 1201), facilitates passing of the string through a string hole, and also minimizes damage to the string hole; however, the same works the other way around in that the knob parts (0701, 1201) deform easily and have poor original-shape recoverability, which creates a drawback of the knob parts (0701, 1201) slipping easily through the string hole in situations of vigorous exercise where strong stress generates between each knob part (0701, 1201) and the string hole.

On the other hand, with the strings described in Patent Literatures 2 and 3, the elastic force of the knob parts (0701, 1201) can be strengthened by using, for the tubular main string body (0703), a fiber containing high amount of rubber, etc.; however, doing so makes the knob parts (0701, 1201) themselves hardened, which creates a problem when these strings are passed through a string hole, which is the case with the string described in Patent Literature 1.

BACKGROUND ART LITERATURE

Patent Literature

Patent Literature 1: Japanese Patent No. 3493002
Patent Literature 2: Japanese Patent No. 5079926
Patent Literature 3: Japanese Patent No. 5392519

SUMMARY OF THE INVENTION

Problems to be Solved by the Invention

An object of the invention under the present application is to solve the problems presented by the prior art as mentioned above and provide a string that uses an elastically deformable core material to achieve the same levels of recovering force after passing through a string hole, and of retention force against a string hole, as the string described in Patent Literature 1, while ensuring that the string can be passed as easily through a string hole with a small force as the strings described in Patent Literatures 2 and 3.

Another object of the invention under the present application is, by applying the string described in Patent Literature 1 also to various types of elastically deformable strings that do not require knots, improved by the present applicant, to provide various types of more advanced elastically deformable string that do not require knots.

Means for Solving the Problems

To achieve the aforementioned objects, a first invention under the present application is a string that has multiple knob parts placed in the direction of axis and is elastically deformable in the direction of axis, characterized in that: the string comprises an outer layer that defines the outer shape of the string, and a core material continuously placed inside, and over the entire length of, the outer layer; the outer layer comprises the knob parts that are constituted by outer layer yarns woven loosely, and link parts that are constituted by the outer layer yarns woven densely and also having a smaller diameter than the knob parts, wherein the knob parts formed in the outer layer are elastically deformable; and the core material is constituted by a stretchable string and placed inside the knob parts in a slackened and/or meandering state.

Also, to achieve the aforementioned objects, a second invention under the present application is a string that has knob parts and a long elastic part placed in the direction of axis and is elastically deformable in the direction of axis, characterized in that: the string comprises an outer layer that defines the outer shape of the string, and a core material continuously placed inside, and over the entire length of, the outer layer; the outer layer comprises the knob parts and long elastic part that are constituted by outer layer yarns woven loosely, and link parts that are constituted by the outer layer yarns woven densely and also having a smaller diameter than the knob parts and long elastic part, wherein the knob parts and long elastic part of the outer layer are elastically deformable; and the core material is constituted by a stretchable string and placed inside the knob parts and long elastic part in a slackened and/or meandering state.

Furthermore, to achieve the aforementioned objects, a third invention under the present application is a string that is elastically deformable in the direction of axis, whose intermediate area excluding the left and right end areas is divided into multiple areas exerting different elastic forces and whose cross-section has roughly the same circular shape over the entire length in the direction of axis, characterized in that: the string comprises an outer layer that defines the outer shape of the string, and a core material continuously placed inside, and over the entire length of, the outer layer; the intermediate area of the outer layer has multiple areas formed in it which are woven differently from outer layer yarns to exert different elastic forces; the left and right end areas of the outer layer are formed by outer layer yarns woven densely; and the core material is constituted by a stretchable string and placed inside the intermediate area in a slackened and/or meandering state.

Effects of the Invention

According to the first invention under the present application having the aforementioned constitution, the knob parts formed in the outer layer exert an elastic force similar to what is intended by the prior art (Patent Literatures 2 and 3), which means that, when the string is passed through a string hole at a normal speed, the knob parts deform to reduce the frictional forces between the string hole and the knob parts, and because the core material is still in a slackened and/or meandering state in this condition, it has generated little elastic force and thus injury to the user's fingers or damage to the string hole itself can be prevented when the string is set in the string hole, and once the string has been set, the elastic force of the core material placed inside the knob parts in a slackened and/or meandering state is additionally exerted, thereby enabling the knob parts to hardly slip through the string hole even in situations of vigorous exercise.

Also, according to the second invention under the present application having the aforementioned constitution, the long elastic part exerting a frictional resistance force against the string hole can stop the string at an arbitrary position relative to the string hole and thus make setting easy, and when the string is used as a shoe lace, a good part of the string showing on the shoe has no knob parts and thus the string looks clean and neat and no different from how a standard shoe lace looks when set. Furthermore, the elastic force of the core material placed inside the long elastic part in a slackened and/or meandering state is additionally exerted, thereby enabling the long elastic part to hardly shift from the string hole even in situations of vigorous exercise.

Also, according to the third invention under the present application having the aforementioned constitution, the multiple areas exerting different elastic forces formed in the intermediate area in the direction of axis allow the necessary tension to be applied to the necessary location when the string is set on a shoe or clothing, while the absence of knob parts like those under the first and second inventions eliminates the need for cumbersome passing operations when setting the string or correcting its tension and it furthermore makes the string look the same as any standard string and also clean and neat. Furthermore, the elastic force of the core material placed inside the intermediate area in a slackened and/or meandering state is additionally exerted, thereby keeping the set string from shifting in position even in situations of vigorous exercise.

As mentioned above, all of the first, second, and third inventions under the present application represent a string that, by using an elastically deformable core material, allows the core material to be placed in a slackened and/or meandering state inside the knob parts or long elastic part or in the intermediate area of the outer layer, and this not only eliminates the stress concentration that would otherwise generate in a rubber material placed in a straight line, as is the case with the string described in Patent Literature 1 (if a rubber material is used by itself, it can be placed in a straight line only), to prevent breakage of or damage to the core material, but it also increases the elastic force of the entire string, compared to the strings described in Patent Literatures 2 and 3 that demonstrate an elastic force solely with the outer layer, to effectively enable the string to be prevented from slipping through the string hole or shifting in position.

BRIEF DESCRIPTION OF THE DRAWINGS

FIG. 1 A general perspective view of the string pertaining to the present invention.

FIG. 2 Drawings for schematically explaining the cross-section of the string pertaining to the first embodiment of the present invention.

FIG. 3 A drawing for schematically explaining a string manufacturing apparatus and manufacturing method, wherein (a) shows a weaving structure and (b) shows a weaving process.

FIG. 4 A drawing for schematically explaining the cross-section of the string pertaining to a variation example of the first embodiment of the present invention.

FIG. 5 A drawing for schematically explaining the cross-section of the string pertaining to the second embodiment of the present invention.

FIG. 6 A drawing for schematically explaining the cross-section of the string pertaining to the third embodiment of the present invention.

FIG. 7 A traditional string having knob parts (1).

FIG. 8 A traditional string having knob parts (2).

FIG. 9 A traditional string having knob parts (3).

MODE FOR CARRYING OUT THE INVENTION

The respective embodiments of the present invention are explained in detail below using the drawings. It should be noted that the present invention is not limited to these embodiments in any way, and may be implemented in various modes to the extent that doing so does not deviate from the key points of the present invention. It should be noted that, under the present invention, the "slackened and/or meandering state" of the core material means the core material exerting an elastic force is shaped not in a manner in which it extends straight, but in a manner in which it slackens and/or meanders.

FIG. 1 is a general perspective view of the elastically deformable string 1 pertaining to the first embodiment of the present invention. FIG. 1 shows a general image of the string 1 in a natural state free from external forces. Multiple knob parts 2 of the same diameter are placed at appropriate intervals in the direction of axis, and knob part 2 and knob part 2 are linked by a link part 3 of a smaller diameter placed in between. Normally the diameter of the link part 3 is smaller than the string hole formed in the setting target (such as string holes in a shoe), while the diameter of the knob part 2 is larger than the string hole, so that the link part 3 passes through the string hole without making frictional contact and the knob part 2 passes through the string hole by making frictional contact and thus deforming. Both end parts of the string 1 are each a lead part to be guided through the string hole first, constituted basically in the same manner as or thinner and firmer than the link part 3, and covered with a resin, etc., to prevent unraveling of the string or coming apart of the yarns.

FIG. 2 provides drawings showing schematic illustrations of the cross-section of the string 1, where (a) shows the string in a natural state free from external forces, while (b) shows the string in a state where it is pulled to the maximum extent by an external force applied from the direction of axis. As shown in FIG. 2, the string 1 comprises an outer layer 4 that forms its outer shape, and a core material 5 continuously placed inside, and over the entire length of, the outer layer 4. The construction of the outer layer 4 is basically the same as that per Japanese Patent No. 5079926, representing a braided string that has been woven from stretchable yarns and non-stretchable yarns combined in an appropriate manner, wherein knob parts 2 are formed as soft bulges by loose weaving, and link parts 3 are formed by dense weaving to be firm and thin (effectively these link parts 3 do not deform elastically, just like standard strings).

The core material 5 is a thin, elastically deformable woven string placed in the outer layer 4, and as shown in FIG. 2 (*a*), it is placed in a meandering state inside the knob parts 2, and in a straight extending state inside the link parts 3.

The core material 5 is formed as a woven string (such as a braided string or spool-knit string) which has been woven using, at an appropriate quantity ratio, stretchable yarns made of natural rubber, synthetic rubber or other elastic material and non-stretchable yarns made of nylon, polyester, or other non-elastic material, and which therefore has stretchability. The elastic force of the core material 5 can be changed according to the quantity ratio of stretchable yarns and non-stretchable yarns. For example, stretchable yarns and non-stretchable yarns can be woven at a quantity ratio of 1:1, 1:2, 1:3, 1:4, 1:5, 1:6 or any other appropriate quantity ratio. The elastic force of the core material 5 can be adjusted by determining this quantity ratio as deemed appropriate.

Also, the woven string used for the core material 5 may be a woven string that has been woven solely from known, so-called stretchable composite fiber yarns integrating stretchable fibers and non-stretchable fibers. When these stretchable composite fiber yarns are used, fine stretchable fibers and fine non-stretchable fibers can be blended at an appropriate ratio and therefore the elastic force of the core material 5 can be adjusted finely compared to when the aforementioned stretchable yarns and non-stretchable yarns are used. In consideration of the function of the core material 5, preferably for the invention under the present application the blending percentage of stretchable fibers is 15 to 50 percent relative to non-stretchable fibers.

FIG. 3 is a schematic illustration of an apparatus and method for manufacturing the string 1; specifically, nylon yarns 7 being non-stretchable yarns and rubber yarns 8 being stretchable yarns are combined in an appropriate manner and woven around the core material 5, produced in advance as described above, at the center, wherein the yarns are woven loosely or densely by adjusting the pulling speed to form knob parts 2 that are soft bulges, as well as link parts 3 that are firm and thin, as an outer layer 4. At the same time, the core material 5 positioned at the center, inside the outer layer, is placed in a meandering state inside the knob parts 2, and in a straight extending state inside the link parts 3.

The core material 5 is in contact (under pressure) with the outer layer 4 inside the firm, thin link parts 3, but not in contact with the outer layer 4 and remains virtually in a free, meandering state inside the soft, bulging knob parts 2.

The string 1 manufactured using the above apparatus and method is such that its knob parts 2 that have been formed as soft bulges by loose weaving are easy to deform elastically under an external force applied from the direction of axis, while its link parts 3 that have been formed firm and thin by dense weaving hardly deform.

The knob part 2 resists an external force based on two forces—the elastic force of the outer layer 4 and the elastic force of the core material 5—while also exerting a recovery force; however, when the knob part 2 is passed through a string hole at a normal speed, the frictional force between the string hole and the knob part 2 is proportional to the elastic force of the knob part of the outer layer 4, and therefore the knob part can be passed with a small force. This is because the core material 5 is still in a slackened and/or meandering state in this condition and has generated little elastic force, which means that the elastic force of the knob part 2 is the only resistance that must be overcome as it passes through the string hole. In a situation of vigorous exercise, on the other hand, a large external force is applied rapidly to the string 1 as a whole (or locally), in which case the elastic force of the outer layer 4 exerted by the knob part 2 is combined with the elastic force exerted by the core material 5 to increase the resistance force, thus eliminating the chances of the knob part 2 slipping easily through the string hole.

Table 1 shows the results of testing Samples 1 to 7 prepared based on this embodiment, as well as Comparative Examples 1 and 2, for overall elastic force of the string 1, impact of the knob part on the string hole, etc. Comparative Example 1 represents a string based on the invention described in Patent Literature 2, while Comparative Example 2 represents a string based on the invention described in Patent Literature 1, and all of Samples 1 to 7 and Comparative Examples 1 and 2 were produced with an overall length of 50 cm, knob part diameter of 7 mm, and 30 knob parts.

TABLE 1

| | Material | | | | | Measurement results | | | | | | | | | | | | | | | | | | |
|---|---|---|---|---|---|---|---|---|---|---|---|---|---|---|---|---|---|---|---|---|---|---|---|---|
| | | | | | | | | Ease of passing through string hole, degree of damage to string hole | | | | | | | | | | | | | | | | Tensile test of core material |
| | | | | | | | | String hole passing test | | | | | | | Difference between initial string hole diameter and string hole diameter after passing test | | | | | | | | | Max. |
| | Core material | Outer layer | | | Number | Pulling force | | Initial string | | | | | | | | | | | | | | | | elongation of 100-mm |
| | Ny: Synthetic rubber | Ny: Synthetic rubber | String length cm | Knob diameter mm | of knobs knobs | 5 cm g | 10 cm g | hole diameter mm | 1 pass mm | 5 passes mm | 10 passes mm | 25 passes mm | 50 passes mm | 100 passes mm | 1 pass mm | 5 passes mm | 10 passes mm | 25 passes mm | 50 passes mm | 100 passes mm | Rate of expansion % | string Elongation mm |
| Sample 1 | 5:1 Woven string | 96:8 Braided string | 50 | 7 | 30 | 280 | 415 | 4.0 | 4.1 | 4.2 | 4.2 | 4.2 | 4.2 | 4.2 | 0.1 | 0.2 | 0.2 | 0.2 | 0.2 | 0.2 | 105% | 195 |
| Sample 2 | 4:2 Woven string | Same as above | 50 | 7 | 30 | 410 | 635 | 4.0 | 4.1 | 4.1 | 4.2 | 4.2 | 4.3 | 4.3 | 0.1 | 0.1 | 0.2 | 0.2 | 0.3 | 0.3 | 108% | 200 |
| Sample 3 | 3:3 Woven string | Same as above | 50 | 7 | 30 | 435 | 665 | 4.0 | 4.3 | 4.3 | 4.3 | 4.5 | 4.6 | 4.8 | 0.3 | 0.3 | 0.3 | 0.5 | 0.6 | 0.8 | 120% | 175 |
| Sample 4 | 2:4 Woven string | Same as above | 50 | 7 | 30 | 560 | 735 | 4.0 | 4.4 | 4.4 | 4.6 | 4.8 | 4.8 | 4.8 | 0.4 | 0.4 | 0.6 | 0.8 | 0.8 | 0.8 | 120% | 160 |
| Sample 5 | 1:5 Woven string | Same as above | 50 | 7 | 30 | 620 | 965 | 4.0 | 4.4 | 4.4 | 4.6 | 4.8 | 4.8 | 4.8 | 0.4 | 0.4 | 0.6 | 0.8 | 0.8 | 0.8 | 120% | 150 |
| Sample 6 | 32:8 Braided string | Same as above | 50 | 7 | 30 | 400 | 565 | 4.0 | 4.1 | 4.1 | 4.2 | 4.2 | 4.2 | 4.2 | 0.1 | 0.1 | 0.2 | 0.2 | 0.2 | 0.2 | 105% | 200 |
| Sample 7 | 88:12 (Ny + synthetic rubber twisted yarn) Spool-knit yarn | Same as above | 50 | 7 | 30 | 175 | 270 | 4.0 | 4.1 | 4.1 | 4.1 | 4.2 | 4.2 | 4.2 | 0.1 | 0.1 | 0.1 | 0.2 | 0.2 | 0.2 | 105% | 225 |
| Comparative Example 1 | 6:0 Spool-knit string | Same as above | 50 | 7 | 30 | 120 | 200 | 4.0 | 4.0 | 4.1 | 4.1 | 4.1 | 4.2 | 4.2 | 0.0 | 0.1 | 0.1 | 0.1 | 0.2 | 0.2 | 105% | 20 |
| Comparative Example 2 | 100% rubber material | 96:0 100% non-stretchable material | 50 | 7 | 30 | 390 | 560 | 4.0 | 4.5 | 4.8 | 5.2 | 5.5 | 5.8 | 6.0 | 0.5 | 0.8 | 1.2 | 1.5 | 1.8 | 2.0 | 150% | 170 |

The pulling forces are forces in grams needed to elongate the respective strings by 5 cm and 10 cm, respectively, and indicate the forces (elastic forces) of the entire strings to resist an external force. As shown in Table 1, Samples 1 to 7 each exhibited large elastic forces of two to five times the elastic forces of Comparative Example 1, and could also exhibit greater elastic forces than Comparative Example 2 when the quantity of elastic material was increased.

In the string hole passing test, the knob parts of the respective strings were passed a total of 100 times through a 4-mm circular string hole formed in cardboard to measure the degree of deformation/enlargement of the string hole, thereby measuring the forces (elastic forces) of the knob parts to resist an external force. As a result of the test, Samples 1 to 7 made the string hole larger by a maximum of 20 percent or so; however, these results were not much different from the results of Comparative Example 1, while Comparative Example 2 caused significant damage to the string hole.

As is evident from the test results above, since each knob part 2 of the string 1 pertaining to this embodiment passes through the string hole by using almost solely the elastic force thereof, no significant force is required, and damage to the string hole can also be prevented. It should be noted that, if the string hole is constituted as a string hole with a metal ring crimped around it, any damage to the string hole is minimized even when the knob parts 2 are firm, which means that the knob parts can have a slightly larger elastic force; in Comparative Example 2 where the knob parts do not deform elastically, however, passing them through such string hole is difficult.

The right-most column in Table 1 shows the tensile test results of only the samples with 10-cm core materials, indicating the maximum elongation of each core material (its length when maximally stretched), where clearly the core materials 5 of Samples 1 to 7 have a greater elongation property than the core material of Comparative Example 1. It is also clear that some samples undergo a greater elastic deformation than does Comparative Example 2 that uses only a rubber material. This is because the core material 5 according to the invention under the present application is formed by weaving a rubber or other stretchable material in such a way that this stretchable material is woven in a spiraling or meandering state, in a state longer than its natural length, into the core material 5 of a prescribed length, thus effecting a greater elastic deformation than can Comparative Example 2 which only uses a rubber material. With these samples, therefore, the elastic force can be changed in a more flexible manner than with Comparative Example 2 which uses one thick rubber yarn.

It should be noted that, while the samples prepared for the aforementioned tests were prepared from stretchable yarns and non-stretchable yarns combined at several representative quantity ratios, the invention under the present application is not limited to these quantity ratios.

FIG. 4 is a schematic illustration of the cross-section of the string 1 pertaining to a variation example of the first embodiment mentioned above. In this variation example, knob parts 2 having multiple different diameters are placed in the direction of axis of the string 1 so that, if it is used as a shoe string, for example, the knob parts 2 to be on the toe side of the shoe will have smaller diameters, while the knob parts 2 to be on the instep side will have larger diameters, to facilitate the setting of the string in the string holes. Placed inside the knob parts 2 having various diameters in this variation example is a core material 5, also in a meandering state. For the detailed construction of this outer layer, refer to International Patent Laid-open No. WO2018/163268A1 proposed by the applicant of the present invention.

It should be noted that, while the core material 5 is in a meandering state inside the knob parts 2 in the first embodiment and variation example thereof, it only needs to be in a state not extending straight, or in a so-called "slackened" state.

Next, the second embodiment of the present invention is explained. FIG. 5 is a schematic illustration of the cross-section of a string 1 whose part to be passed through a string hole and fixed is formed not as a knob part 2, but as a long elastic part 6. This long elastic part is formed as a continuous non-dense part in the process of weaving the outer layer 4, and can also deform elastically just like the knob parts 2 in the first embodiment. It should be noted that, for the detailed construction of the outer layer 4 pertaining to the second embodiment, refer to Japanese Patent Application No. 2017-57383 proposed by the applicant of the present invention.

The core material 5 is placed in a meandering (and/or slackened) state inside the long elastic part 6, and the string 1 can stretch due to two elastic forces: the elastic force of the long elastic part 6 and the elastic force of the core material 5.

It should be noted that stopper knobs 10 placed on both the left and right sides of the string 1 are string-end knobs that have been formed to maintain the string 1 in a set state once it has been set on a shoe, etc., and in the sense that they are provided to function as so-called "end stoppers," the purpose and function of these knobs are different from those of the knob parts 2 placed over the entire length of the string 1 in the first embodiment.

Also, the diameter of the long elastic part 6 in its natural state may be the same as, or smaller or greater than, the diameter of the stopper knobs 10 placed on both the left and right sides of the string 1. Furthermore, the link parts 3 explained in the first embodiment may be used between the long elastic part 6 and the stopper knobs 10.

According to the string 1 in the second embodiment, it can be argued that, when the long elastic part 6 is passed through a string hole at a normal speed, for example, the frictional force between the string hole and the long elastic part 6 is proportional to the elastic force of the outer layer 4, and therefore the long elastic part can be passed with a small force. This is because the core material is still in a slackened and/or meandering state in this condition and has generated little elastic force, which means that the elastic force of the long elastic part 6 is the only resistance that must be overcome as it passes through the string hole. In a situation of vigorous exercise, on the other hand, a large external force is applied rapidly to the string 1 as a whole (or locally), in which case the elastic force of the outer layer 4 exerted by the long elastic part 6 is combined with the elastic force exerted by the core material 5 to increase the resistance force against such external force, thus eliminating the chances of the long elastic part 6 slipping easily through the string hole.

Next, the third embodiment of the present invention is explained. FIG. 6 is a schematic illustration of the cross-section of a string 1 whose outer layer 4 has an intermediate area, excluding the stopper knobs 10 placed on both the left and right sides, which is formed as an intermediate area 9 of the same diameter as any standard shoe string, etc., and this intermediate area 9 is divided into areas A, B and C exerting three different elastic forces (tensile moduli). For the detailed construction of the outer layer pertaining to this third embodiment, refer to Patent Application No. 2018-104865 proposed by the applicant of the present invention. Also, there may be areas exerting two, four, or more different elastic forces, arranged in such a way that their positioning corresponds to an order of gradually decreasing (or increasing) elastic force, or they are positioned repeatedly in a sequence of high, medium, low, medium, high, and so on.

The core material 5 is placed in a slackened (or meandering) state inside the outer layer 4 in the intermediate area 9, and the string 1 can stretch due to two elastic forces: the elastic force of the outer layer 4 in the intermediate area 9 and the elastic force of the core material 5.

The string 1 pertaining to the third embodiment is different from the first and second embodiments where the knob parts 2 and long elastic part 6 are locked in place based on their position relationship with a string hole, in that, while it is set in the same manner as any normal string would be with respect to a string hole, its outer layer 4 in the intermediate area 9 comprises multiple areas exerting different elastic forces as formed in the direction of axis, and therefore the necessary tension can be applied to the necessary location when the string is set on a shoe or clothing, while the absence of knob parts 2 and long elastic part 6 like those under the first and second inventions eliminates the need for cumbersome passing operations when setting the string or correcting its tension and it furthermore makes the string look the same as any standard braided string and also clean and neat.

Furthermore, the core material 5 placed inside the outer layer 4 in the intermediate area 9 in a meandering (and/or slackened) state exerts its elastic force, in addition to the elastic force of the outer layer 4, to prevent the set string 1 from shifting in position even in situations of vigorous exercise.

It should be noted that, just like in the second embodiment, the stopper knobs 10 placed on both the left and right sides of the string 1 are knobs to maintain the string 1 in a set state once it has been set on a shoe, etc., and in the sense that they are provided to function as so-called "end stoppers," the purpose and function of these knobs are different from those of the knob parts 2 placed over the entire length of the string 1 in the first embodiment.

Also, in each of the aforementioned embodiments, the core material 5 was explained as a braided string or spool-knit string; besides these, however, it may be any of various types of woven strings, or even a twisted string. Whatever the case may be, any string whose core material 5 combines stretchable fibers and non-stretchable fibers and is therefore stretchable (elastic composite fiber string), suffices.

The method for manufacturing the string 1 pertaining to the second embodiment or third embodiment mentioned above is basically the same as that in the first embodiment, and thus not explained in detail.

The foregoing can be summarized that, according to the string 1 pertaining to each invention under the present application, not only there are deformable knob parts in the outer layer 4, but the core material 5 placed inside the outer layer is also elastically deformable, which means that the user can pass the string through a string hole only with a small force that resists the elastic force of the knob part in the outer layer 4, thus preventing the user from injuring his/her fingers or damaging the string hole, and once the string has been set, any external force can be resisted by the elastic force of the outer layer 4 and the elastic force of the core material 5, thus enabling the knob part to be prevented from slipping through the string hole or shifting easily from the prescribed position.

DESCRIPTION OF THE SYMBOLS

1 String
2 Knob part
3 Link part
4 Outer layer
5 Core material
6 Long elastic part
7 Nylon yarn
8 Rubber yarn
9 Intermediate area
10 Stopper knob

What is claimed is:

1. An elastically deformable string, which is a string that has multiple knob parts placed in a direction of axis and is elastically deformable in the direction of axis, characterized in that:

the string comprises an outer layer that defines an outer shape of the string, and a core material continuously placed inside, and over an entire length of, the outer layer;

the outer layer comprises the knob parts that are constituted by loosely woven outer layer yarns and elastically deformable, and link parts that are constituted by densely woven outer layer yarns and have a smaller diameter than the knob parts, wherein the loosely woven outer layer yarns are woven more loosely or less densely than are the densely woven outer layer using same yarns; and the core material is constituted by a stretchable string, portions of which inside the link parts extend in the direction of axis, and portions of which inside the knob parts are placed in a slackened and/or meandering state in a manner manifesting elastic force in the direction of axis to resist axial deformation of the knob parts when extending in the direction of axis together with the knob parts by external force.

2. The elastically deformable string according to claim 1, characterized in that the stretchable string used for the core material is a woven string or twisted string that has been woven or twisted from stretchable yarns and non-stretchable yarns combined at a quantity ratio of 1:1, 1:2, 1:3, 1:4 or 1:5.

3. The elastically deformable string according to claim 1, characterized in that the stretchable string used for the core material is a woven string or twisted string that has been woven or twisted from stretchable composite fiber yarns integrating stretchable fibers and non-stretchable fibers, wherein a blending percentage of the stretchable fibers is 15 to 50 percent relative to the non-stretchable fibers.

4. The elastically deformable string according to claim 1, characterized in that the outer layer is a braided string.

5. The elastically deformable string according to claim 4, characterized in that the stretchable string used for the core material is a woven string or twisted string that has been woven or twisted from stretchable composite fiber yarns integrating stretchable fibers and non-stretchable fibers, wherein a blending percentage of the stretchable fibers is 15 to 50 percent relative to the non-stretchable fibers.

6. The elastically deformable string according to claim 5, characterized in that the stretchable string used for the core material is a woven string or twisted string that has been woven or twisted from stretchable yarns and non-stretchable yarns combined at a quantity ratio of 1:1, 1:2, 1:3, 1:4 or 1:5.

7. The elastically deformable string according to claim 5, characterized in that the outer layer is a braided string.

8. The elastically deformable string according to claim 5, characterized in that an intermediate area of the elastically deformable string excluding left and right end areas including the knob parts of the elastically deformable string is divided into multiple areas exerting different elastic forces and whose cross-section has roughly a same circular shape over an entire length in a direction of axis, wherein the intermediate area is constituted by two or three areas exerting different elastic forces which are placed alternately along the direction of axis.

9. The elastically deformable string according to claim 5, characterized in that an intermediate area of the elastically deformable string excluding left and right end areas including the knob parts of the elastically deformable string is divided into multiple areas exerting different elastic forces and whose cross-section has roughly a same circular shape over an entire length in a direction of axis, wherein the intermediate area is constituted by multiple areas exerting gradually decreasing elastic forces which are placed from one end part toward an other end part, along the direction of axis.

10. The elastically deformable string according to claim 5, characterized in t that an intermediate area of the elastically deformable string excluding left and right end areas including the knob parts of the elastically deformable string is divided into multiple areas exerting different elastic forces and whose cross-section has roughly a same circular shape over an entire length in a direction of axis, wherein the string further comprises, in at least one of the left and right end areas, one or multiple knob parts do not deform elastically.

11. The elastically deformable string according to claim 5, characterized in that an intermediate area of the elastically deformable string excluding left and right end areas including the knob parts of the elastically deformable string is divided into multiple areas exerting different elastic forces and whose cross-section has roughly a same circular shape over an entire length in a direction of axis, wherein the intermediate area is constituted by multiple areas exerting different elastic forces, linked by link parts placed in between which do not deform elastically.

12. The elastically deformable string according to claim 4, characterized in that the outer layer is a braided string.

13. The elastically deformable string according to claim 4, characterized in that a diameter of the knob part is same as a diameter of the long elastic part.

14. The elastically deformable string claim 4, characterized in that a diameter of the long elastic part is smaller or greater than a diameter of the knob part.

15. The elastically deformable string according to claim 1, characterized in that diameters of the knob parts are all same diameters.

16. The elastically deformable string according to claim 1, characterized in that diameters of the knob parts comprise multiple different diameters.

17. An elastically deformable string, which is a string that has knob parts and a long elastic part placed in a direction of axis and is elastically deformable in the direction of axis, said long elastic part being longer than each knob part in the direction of axis, characterized in that:

the string comprises an outer layer that defines an outer shape of the string, and a core material continuously placed inside, and over an entire length of, the outer layer;

the outer layer comprises the knob parts and long elastic part that are constituted by loosely woven outer layer yarns and elastically deformable, and link parts that are constituted by densely woven outer layer yarns and have a smaller diameter than the knob parts and long elastic part, wherein the loosely woven outer layer yarns are woven more loosely or less densely than are the densely woven outer layer using same yarns; and the core material is constituted by a stretchable string, portions of which inside the link parts extend in the direction of axis, and portions of which inside the knob parts and long elastic part are placed in a slackened and/or meandering state in a manner manifesting elastic force in the direction of axis to resist axial deformation of the knob parts when extending in the direction of axis together with the knob parts by external force.

18. The elastically deformable string according to claim 17, characterized in that the stretchable string used for the core material is a woven string or twisted string that has been woven or twisted from stretchable yarns and non-stretchable yarns combined at a quantity ratio of 1:1, 1:2, 1:3, 1:4, or 1:5.

19. An elastically deformable string, which is a string that is elastically deformable in a direction of axis, whose intermediate area excluding left and right end areas is divided into multiple areas exerting different elastic forces and whose cross-section has roughly a same circular shape over an entire length in the direction of axis, characterized in that:

the string comprises an outer layer that defines an outer shape of the string, and a core material continuously placed inside, and over an entire length of, the outer layer;

the intermediate area of the outer layer has multiple areas formed in it which are woven differently from outer layer yarns to exert different elastic forces;

the left and right end areas of the outer layer are formed by densely woven outer layer yarns, the densely woven outer layer yarns being more densely woven than are the intermediate area; and the core material is constituted by a stretchable string and portions of which inside the intermediate area are placed in a slackened and/or meandering state in a manner manifesting elastic force in the direction of axis to resist axial deformation of the intermediate area when extending in the direction of axis together with the intermediate area by external force.

* * * * *